US011097889B2

(12) United States Patent
Accursi et al.

(10) Patent No.: US 11,097,889 B2
(45) Date of Patent: Aug. 24, 2021

(54) CAPSULE FOR THE PREPARATION OF BEVERAGES

(71) Applicant: CAFFITALY SYSTEM S.P.A., Gaggio Montano (IT)

(72) Inventors: Giovanni Accursi, Alto Reno Terme (IT); Roberto Fini, Gaggio Montano (IT)

(73) Assignee: CAFFITALY SYSTEM S.P.A., Gaggio Montano (IT)

( * ) Notice: Subject to any disclaimer, the term of this patent is extended or adjusted under 35 U.S.C. 154(b) by 0 days.

(21) Appl. No.: 16/093,725

(22) PCT Filed: Mar. 12, 2018

(86) PCT No.: PCT/IB2018/051624
§ 371 (c)(1),
(2) Date: Oct. 15, 2018

(87) PCT Pub. No.: WO2018/167641
PCT Pub. Date: Sep. 20, 2018

(65) Prior Publication Data

US 2019/0389650 A1 Dec. 26, 2019

(30) Foreign Application Priority Data

Mar. 17, 2017 (IT) ..... 102017000029991

(51) Int. Cl.
*B65D 85/80* (2006.01)
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/8046
See application file for complete search history.

(56) References Cited

U.S. PATENT DOCUMENTS 7,604,826 B2 10/2009 Denisart et al.
7,681,492 B2 3/2010 Suggi Liverani et al.
(Continued)

FOREIGN PATENT DOCUMENTS

CN 1933753 A 3/2007
CN 101715417 A 5/2010
(Continued)

*Primary Examiner* — Ericson M Lachica
(74) *Attorney, Agent, or Firm* — Pearne & Gordon LLP

(57) ABSTRACT

This disclosure relates to a capsule (1) for making a beverage, containing a powdered food substance (8) which enables a beverage to be made by passing water through it. The capsule (1) comprises a cup-shaped containment body (2), in turn comprising a tubular lateral wall (21) and a bottom portion (22), and a closing element (29) that closes the top of the containment body (2). The bottom portion (22) has a dispensing hole (26) and the containment body (2) defines a containment chamber (20) inside itself. A filtering element (3) is mounted in the containment chamber (20) and is positioned between the powdered food substance (8) and the bottom portion (22). A dispensing element (5) is mounted in the containment chamber (20) and is positioned between the filtering element (3) and the bottom portion (22). The dispensing element (5) is intended to create a tortuous path for the beverage that flows towards the dispensing hole (26). A barrier impermeable to oxygen (6) is mounted in the containment chamber (20) and is interposed between the filtering element (3) and the dispensing element (5). The barrier impermeable to oxygen (6) is a sheet of flexible material fixed in an oxygen-tight way to the containment body (2) and intended to be torn during use, thereby allowing the beverage to pass through it. A flow throttling element (7) is mounted in the containment chamber (20) in a position interposed between the filtering element (3) and the dispensing element (5) and obstructs the passage cross-section for the beverage in the containment
(Continued)

chamber (20). The flow throttling element (7) has at least one through opening (71) through which, in use, the beverage flows towards the dispensing element (5).

21 Claims, 8 Drawing Sheets

(56) References Cited

U.S. PATENT DOCUMENTS

| | | | | |
|---|---|---|---|---|
| 7,685,930 | B2 | 3/2010 | Mandralis et al. | |
| 2004/0228955 | A1 | 11/2004 | Denisart et al. | |
| 2006/0219098 | A1 | 10/2006 | Mandralis et al. | |
| 2007/0062375 | A1 | 3/2007 | Liverani et al. | |
| 2009/0007793 | A1 | 1/2009 | Glucksman et al. | |
| 2009/0211458 | A1 | 8/2009 | Denisart et al. | |
| 2010/0034929 | A1 | 2/2010 | Dogan et al. | |
| 2010/0108541 | A1 | 5/2010 | Roberto | |
| 2010/0282091 | A1 | 11/2010 | Doleac | |
| 2010/0303964 | A1* | 12/2010 | Beaulieu | B65D 85/8043 426/77 |
| 2010/0307930 | A1 | 12/2010 | Zangerle | |
| 2013/0078340 | A1 | 3/2013 | Glucksman et al. | |
| 2013/0180409 | A1 | 7/2013 | Dogan et al. | |
| 2013/0216663 | A1 | 8/2013 | Dogan et al. | |
| 2015/0232263 | A1 | 8/2015 | Talon et al. | |
| 2017/0073153 | A1 | 3/2017 | Bartoli et al. | |
| 2017/0217669 | A1 | 8/2017 | Mastrapasqua et al. | |
| 2018/0016092 | A1 | 1/2018 | Dogan et al. | |
| 2018/0044105 | A1 | 2/2018 | Tomasi | |
| 2018/0327178 | A1* | 11/2018 | Bartoli | B65D 85/8043 |
| 2019/0055084 | A1 | 2/2019 | Durso | |
| 2019/0119036 | A1* | 4/2019 | Nordqvist | B32B 27/32 |
| 2019/0367260 | A1 | 12/2019 | Robotti | |

FOREIGN PATENT DOCUMENTS

| | | | |
|---|---|---|---|
| EP | 1472156 | A2 | 11/2004 |
| EP | 1500358 | A1 | 1/2005 |
| EP | 1574452 | A2 | 9/2005 |
| EP | 1808382 | A1 | 7/2007 |
| ES | 2424296 | A1 | 9/2013 |
| NL | 2020063 | B1 | 6/2019 |
| WO | 2005018395 | A1 | 3/2005 |
| WO | 2005092160 | A1 | 10/2005 |
| WO | 2007039032 | A2 | 4/2007 |
| WO | 2007141202 | A1 | 12/2007 |
| WO | 2008116818 | A1 | 10/2008 |
| WO | 2008126045 | A1 | 10/2008 |
| WO | 2012003891 | A1 | 1/2012 |
| WO | 2014037339 | A1 | 3/2014 |
| WO | 2015004259 | A1 | 1/2015 |
| WO | 2015121881 | A1 | 8/2015 |
| WO | 2015136433 | A1 | 9/2015 |
| WO | 2015189770 | A1 | 12/2015 |
| WO | 2016008865 | A1 | 1/2016 |

* cited by examiner

CAPSULE FOR THE PREPARATION OF BEVERAGES

This invention relates to a capsule for making a beverage, of the type containing a powdered food substance which enables a beverage to be made by passing hot water through it. That food substance may be soluble or of the type which can be extracted by infusion, such as roasted, ground coffee.

In particular, this invention relates to a capsule of the type described in patents EP 1 472 156, EP 1 500 358, EP 1 574 452 and EP 1 808 382. That is to say, a capsule that, when used in a suitable beverage-making machine, is able to dispense the beverage directly into a cup below. That capsule comprises a cup-shaped containment body which has a bottom portion equipped with a dispensing hole. The containment body is closed at the top by a closing element and inside it there is at least one lower filtering element positioned between the powdered food substance and the bottom portion.

For this type of capsule, the capsule is generally made in such a way as to prevent the passage of oxygen towards the powdered food substance before the capsule is used. This prevents the powdered food substance from deteriorating. In addition, at the moment when the capsule is used, the machine for making the beverage pierces only the upper closing element in order to inject water into the capsule. In many prior art capsules, the outflow of the beverage is achieved thanks to the fact that, inside it, the capsule comprises a barrier to oxygen made of a sheet of aluminium which, following the injection of water into the capsule, swells and tears against fixed contact elements present in the capsule. In particular, the lower filtering element is practically completely covered with pyramid-shaped spikes that enable the aluminium sheet to be torn as soon as it swells.

Furthermore, as already indicated, in these prior art capsules the beverage is dispensed directly from the capsule to the cup, that is to say, without contact with any part of the machine. For that purpose, the capsule containment body, which is injection moulded, has a ring that extends outwards and that surrounds the dispensing hole, creating a sort of short tube for guiding the beverage as it comes out, guaranteeing that it is correctly oriented towards the cup below.

It should be noticed that the water injected into the capsule has a high pressure which, after the aluminium sheet has been torn, may produce an irregular flow of beverage with sprays. This problem is greater for capsules that dispense directly into the cup, since there is no dispenser outside of the capsule suitable for regularising the flow of beverage.

Moreover, at the end of beverage dispensing, there may be considerable dripping from the capsule, since the powdered food substance releases the water that it absorbed during the beverage making step. That is inconvenient, because the drops dirty the surface below after removal of the cup and the user also has to handle a dripping capsule.

In this context the main technical purpose which forms the basis of this invention is to provide a capsule for making a beverage that can be used in the same type of machines which use the capsules described above, but which is made in an alternative way to the prior art capsules.

A technical purpose of this invention is also to provide a capsule in which the beverage outflow is regular and substantially free of pressurised sprays.

Another technical purpose of this invention also relates to provide a capsule with substantially negligible or absent dripping at the end of dispensing.

A secondary technical purpose of this invention is to provide a capsule that uses an alternative opening method concerning beverage dispensing.

The technical purpose specified and the aims indicated are substantially achieved by a capsule for making a beverage as indicated in the appended claims.

Further features and the advantages of this invention are more apparent in the detailed description below, with reference to several preferred, non-limiting embodiments of a capsule for making a beverage, illustrated in the accompanying drawings, in which.

With reference to the above-mentioned figures, the numeral 1 denotes in its entirety a capsule made according to this invention.

Similarly to the prior art capsules, the capsule 1 according to this invention contains a powdered food substance 8 that enables a beverage to be made by passing water (in particular, pressurised hot water) through the powdered food substance 8. The powdered food substance 8 may be of the soluble type or of the type which can be extracted by infusion, with water that is more or less pressurised, as described in more detail below. In any case, a certain degree of extraction pressure is always required.

In particular, the powdered food substance 8 is a powder of roasted, ground coffee. The beverage obtained in this way is, for example, an espresso coffee.

Figure 1:
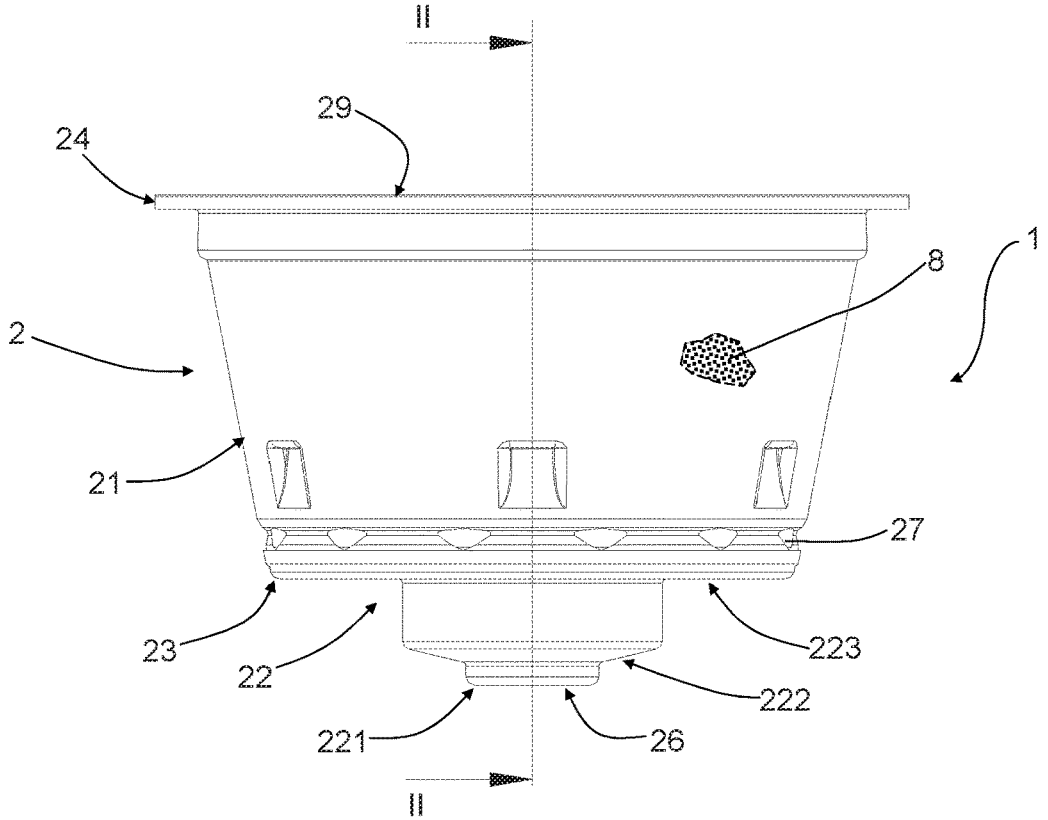
FIG. 1 is a side view of a capsule for making a beverage made according to a first embodiment of this invention, the lateral wall of the capsule being partly interrupted in order to show the inside of the capsule.
Figure 2:
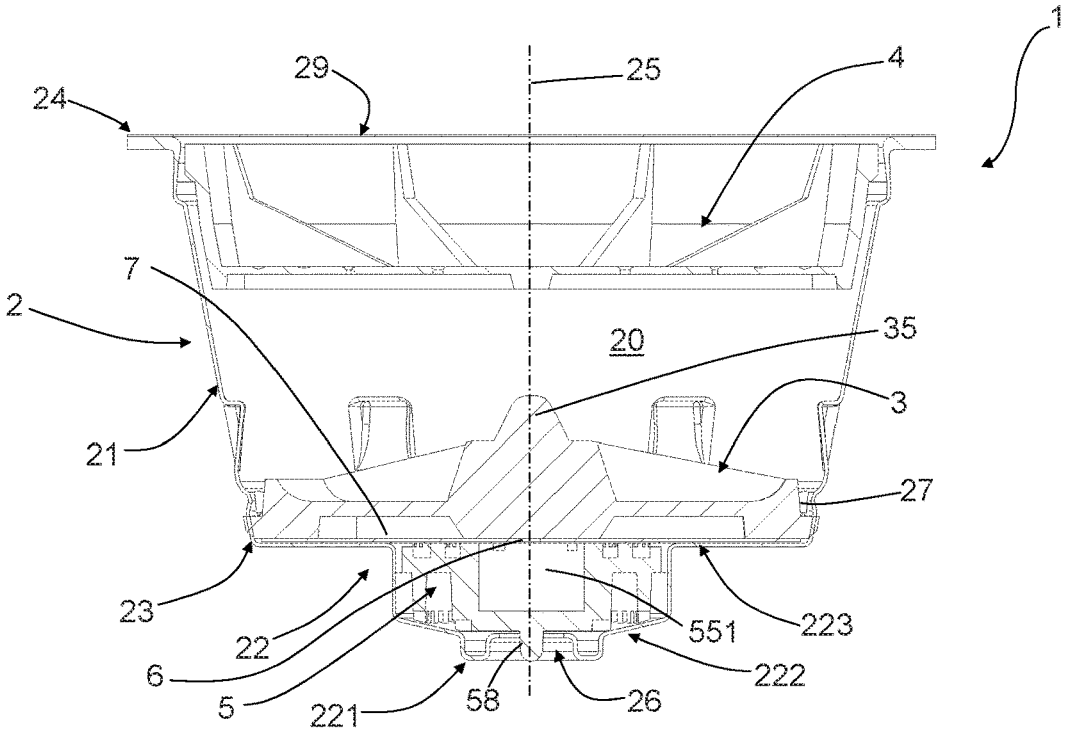
FIG. 2 is a sectional view of the capsule of FIG. 1, sectioned according to the line II-II, and without the powdered food substance, to better illustrate its internal structure.
Figure 3:
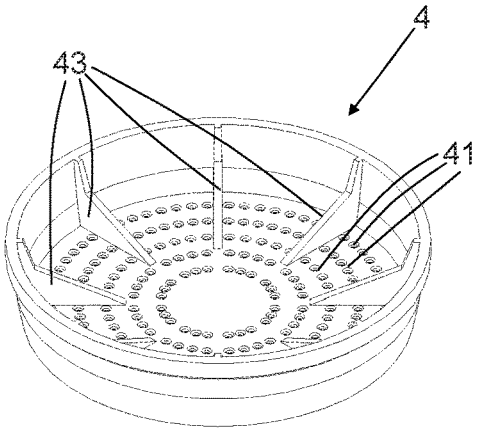
FIG. 3 is a perspective top view of an upper filtering element of the capsule of FIG. 1.
Figure 4:
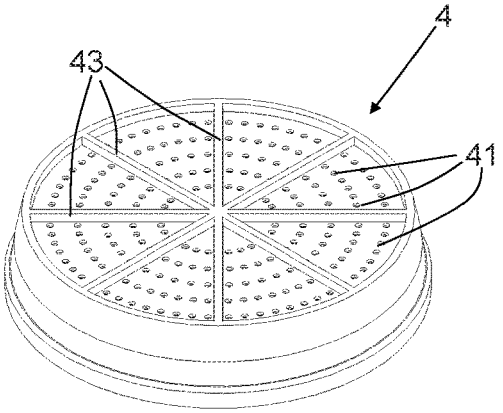
FIG. 4 is a perspective bottom view of the upper filtering element of FIG. 3.
Figure 5:
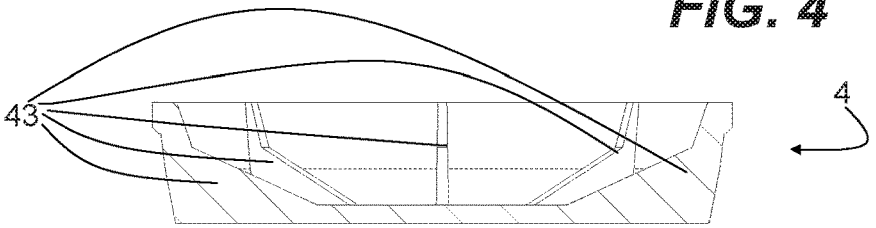
FIG. 5 is a sectional view of the upper filtering element of FIG. 3.
Figure 6:
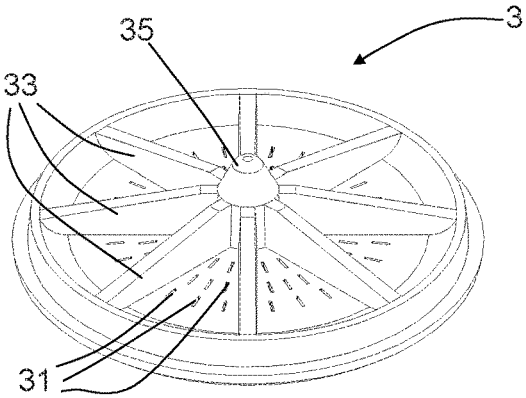
FIG. 6 is a perspective top view of a lower filtering element of the capsule of FIG. 1.
Figure 7:
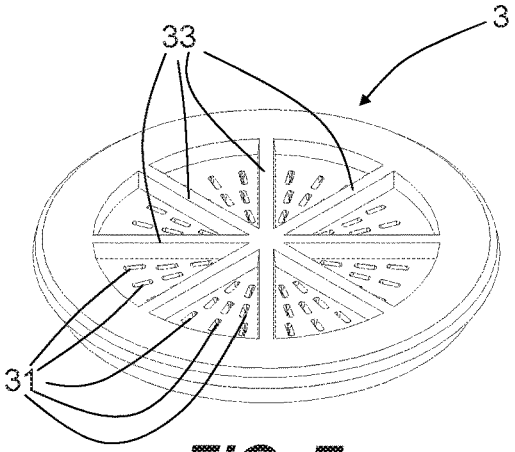
FIG. 7 is a perspective bottom view of the lower filtering element of FIG. 6.
Figure 8:
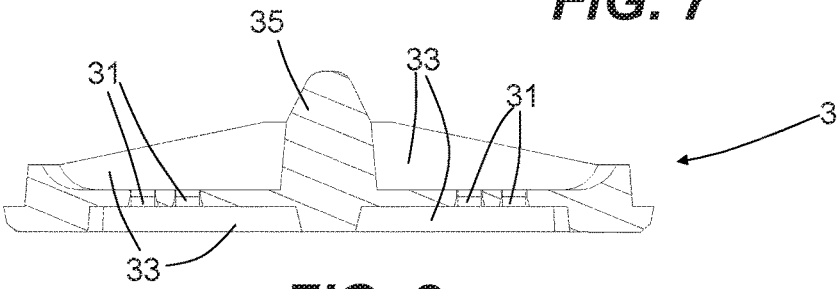
FIG. 8 is a sectional view of the lower filtering element of FIG. 6.
Figure 9:
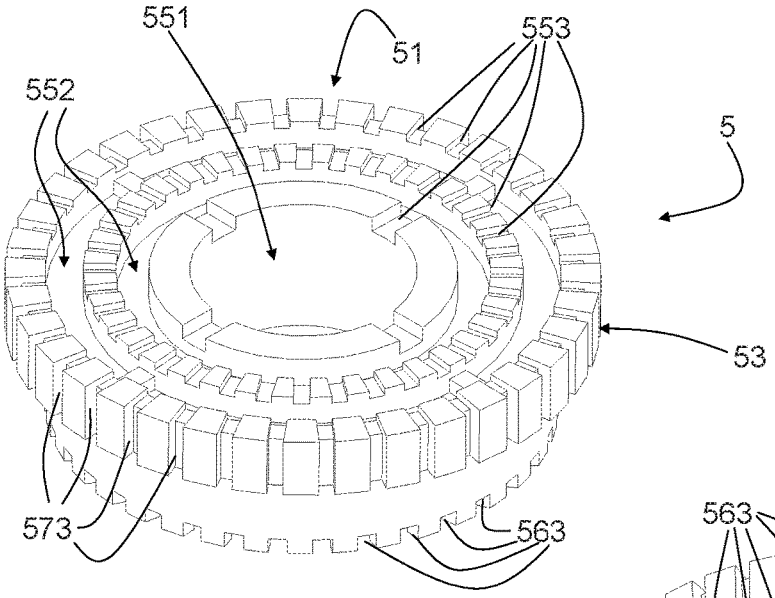
FIG. 9 is a perspective top view of a dispensing element of the capsule of FIG. 1.
Figure 10:
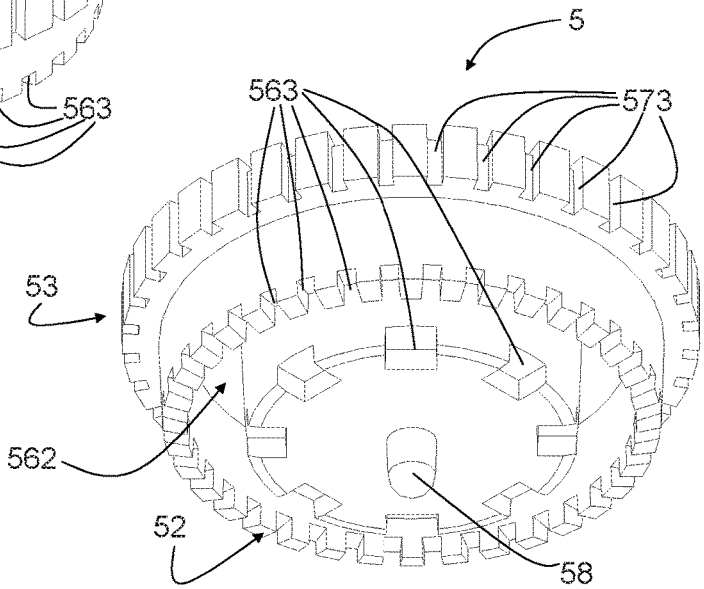
FIG. 10 is a perspective bottom view of the dispensing element of FIG. 9.
Figure 11:
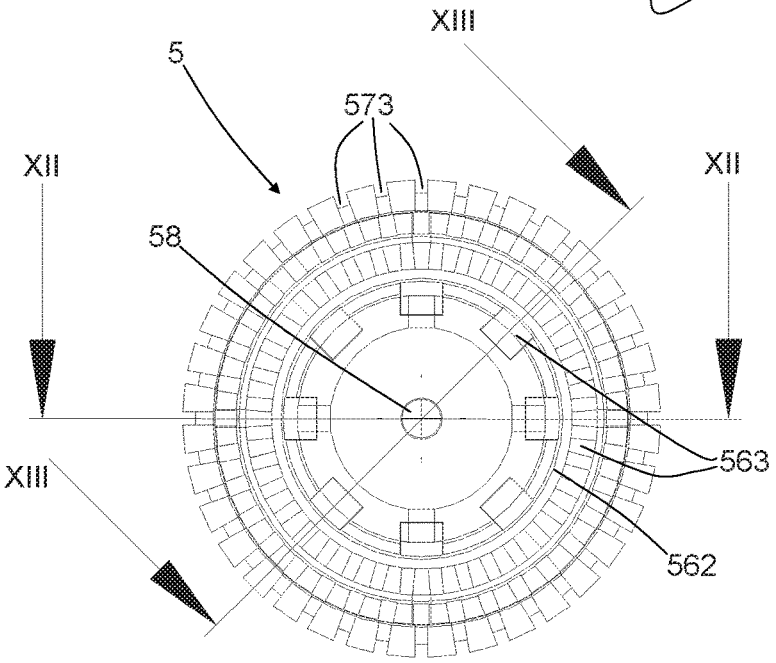
FIG. 11 is a bottom view of the dispensing element of FIG. 9.
Figure 12:
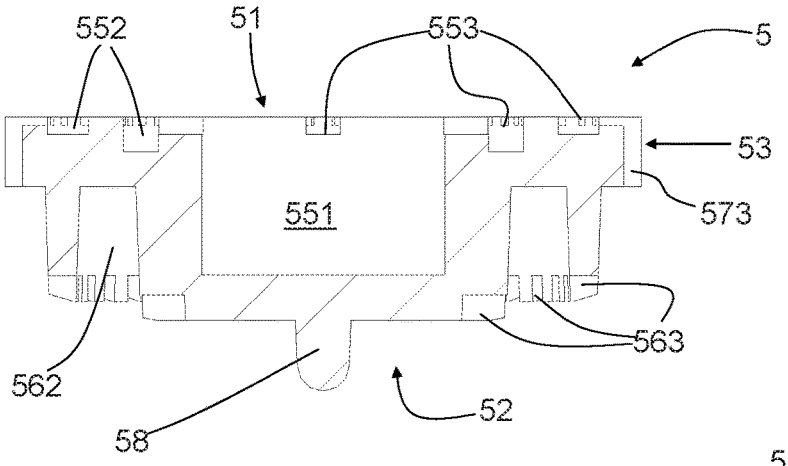
FIG. 12 is a sectional view of the dispensing element of FIG. 9, sectioned according to the line XII-XII.
Figure 13:
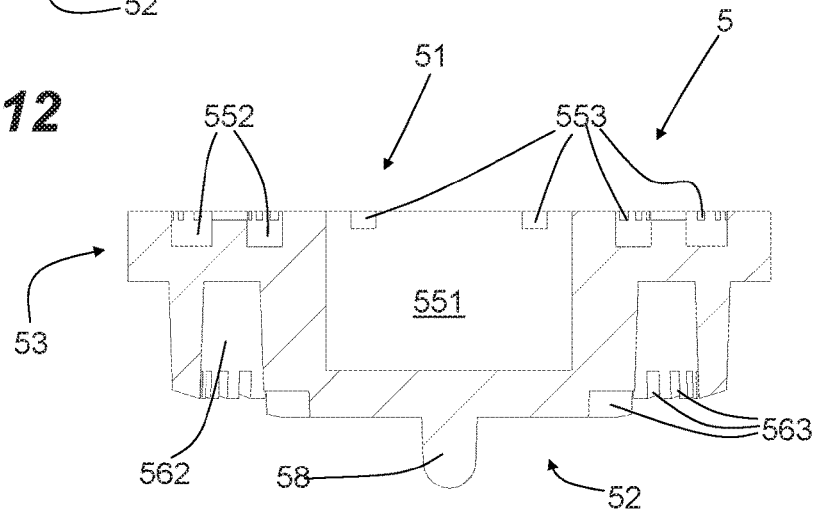
FIG. 13 is a sectional view of the dispensing element of FIG. 9, sectioned according to the line XIII-XIII.
Figure 14:
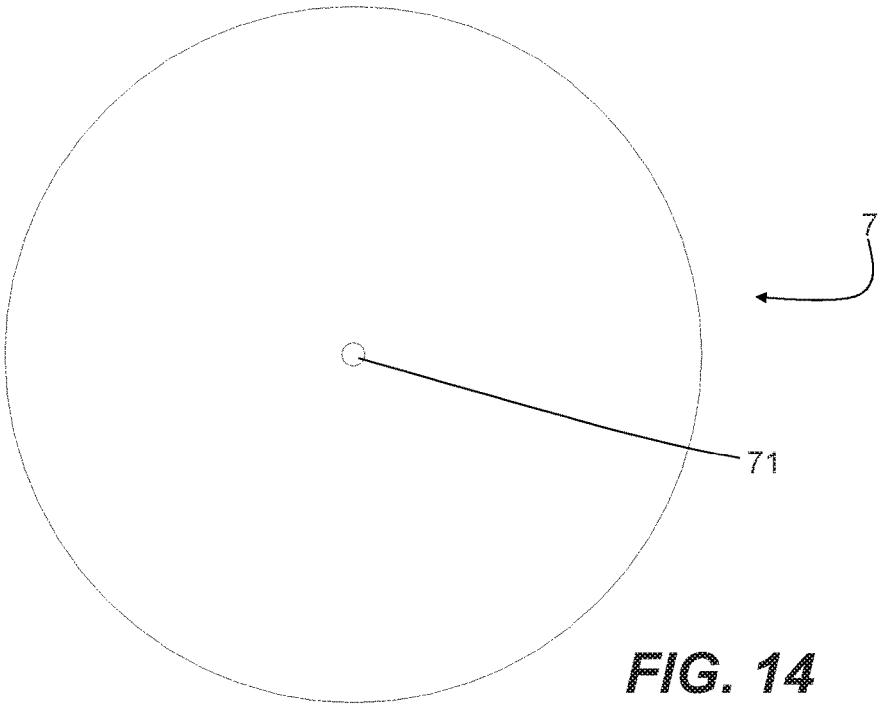
FIG. 14 is a top view of a flow throttling element of the capsule of FIG. 1.
Figure 15:
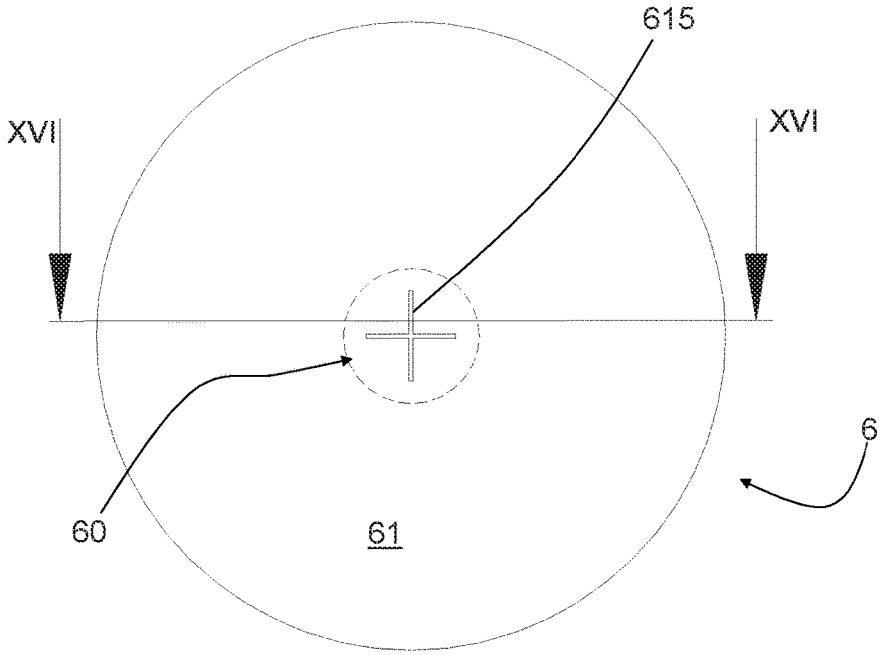
FIG. 15 is a top view of a barrier impermeable to oxygen of the capsule of FIG. 1.
Figure 16:
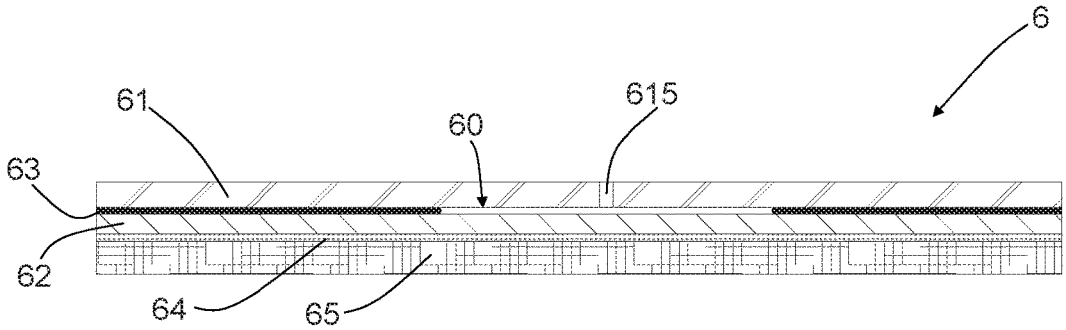
FIG. 16 is an enlarged sectional view of a part of the barrier impermeable to oxygen of FIG. 15, sectioned according to the line XVI-XVI.
Figure 17:
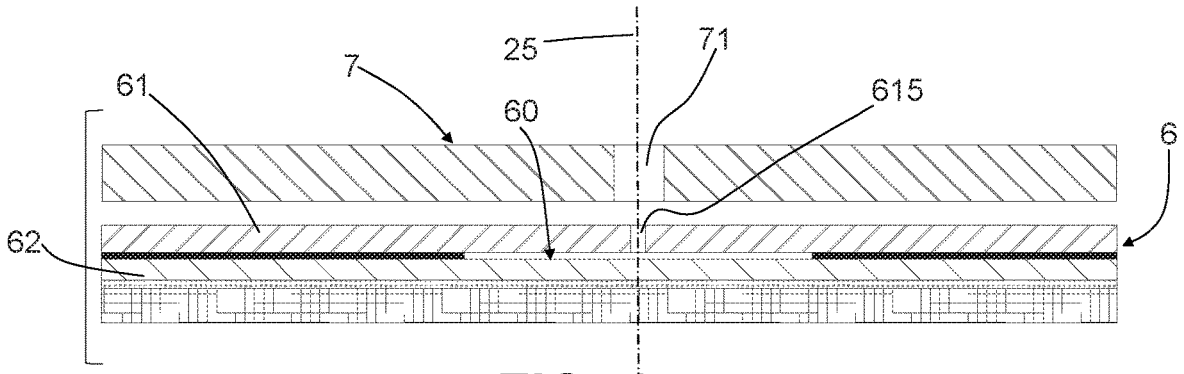
FIG. 17 is an enlarged sectional view of a part of the flow throttling element of FIG. 14 and the part of the barrier impermeable to oxygen of FIG. 16, superposed one over the other.
Figure 19:
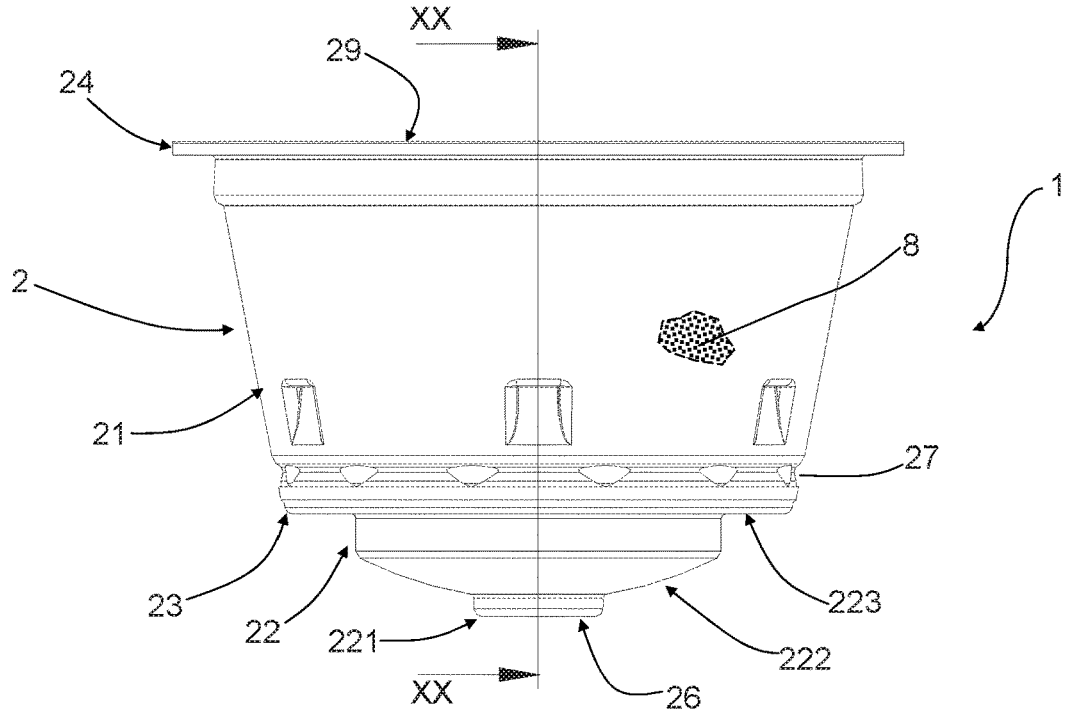
FIG. 19 is a side view of a capsule for making a beverage made according to a second embodiment of this invention, the lateral wall of the capsule being partly interrupted in order to show the inside of the capsule.
Figure 20:
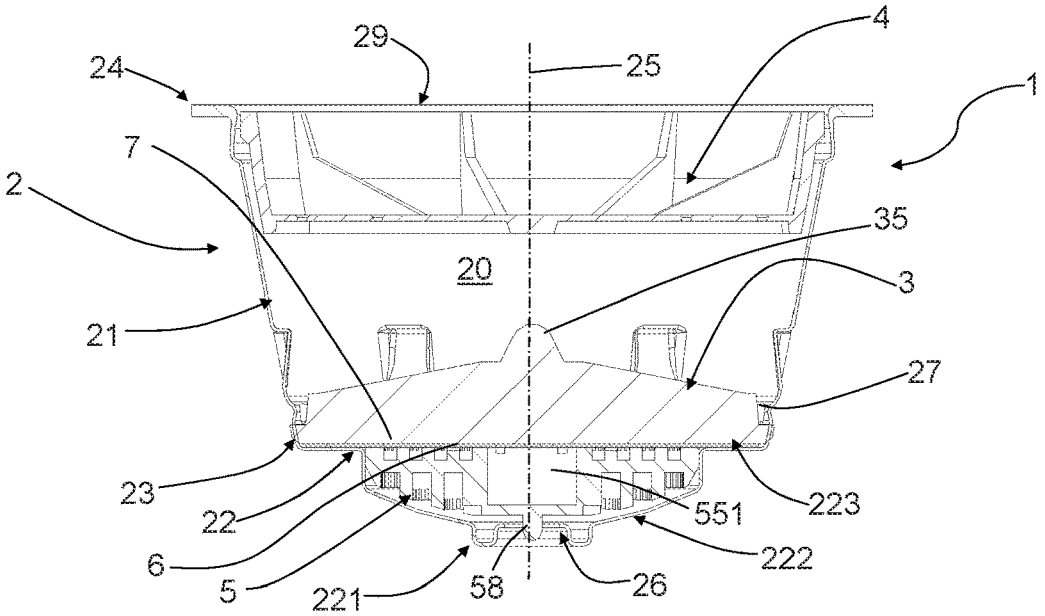
FIG. 20 is a sectional view of the capsule of FIG. 19, sectioned according to the line XX-XX, and without the powdered food substance, to better illustrate its internal structure.
Figure 21:
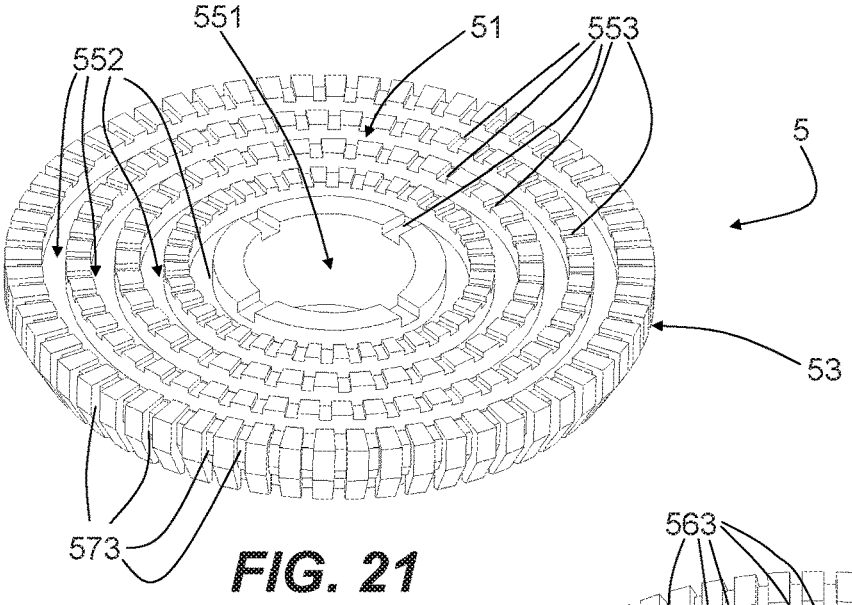
FIG. 21 is a perspective top view of a dispensing element of the capsule of FIG. 19.
Figure 22:
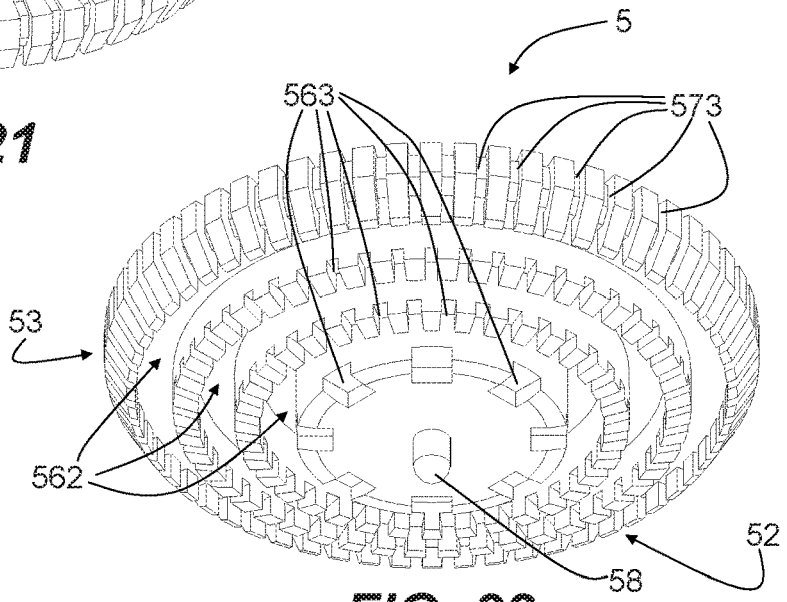
FIG. 22 is a perspective bottom view of the dispensing element of FIG. 21.
Figure 23:
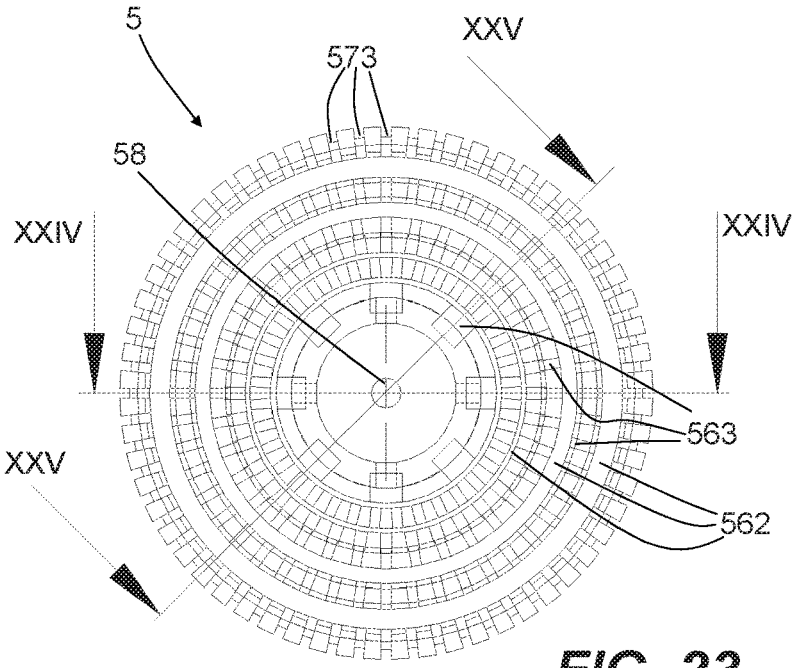
FIG. 23 is a bottom view of the dispensing element of FIG. 21.
Figure 24:
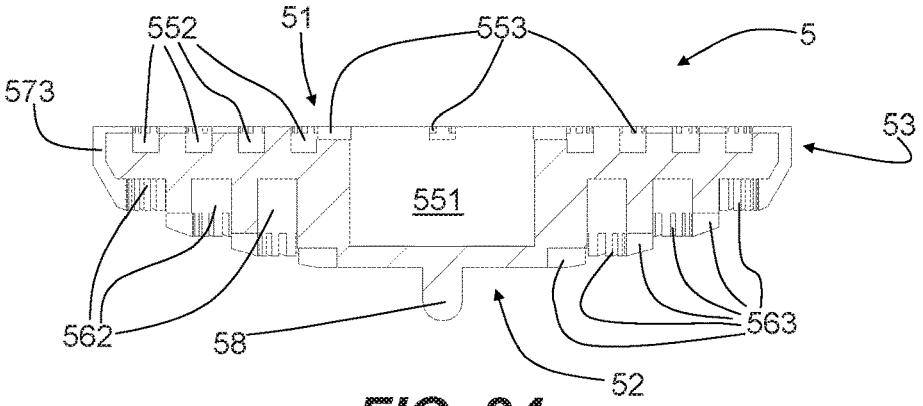
FIG. 24 is a sectional view of the dispensing element of FIG. 21, sectioned according to the line XXIV-XXIV.
Figure 25:
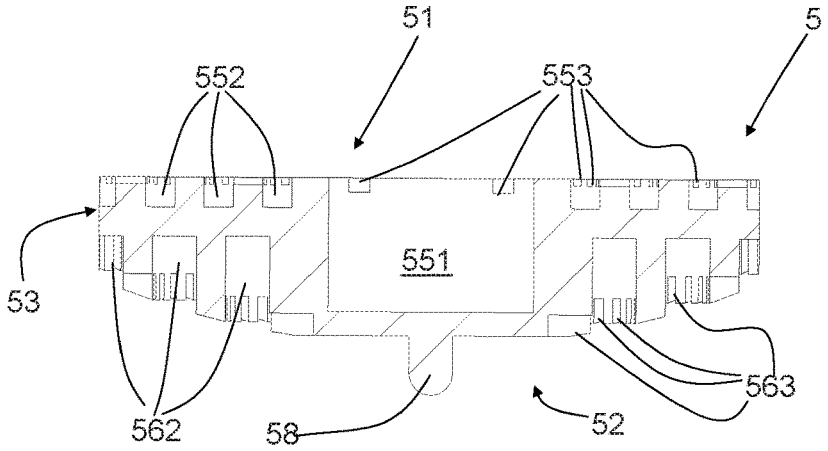
FIG. 25 is a sectional view of the dispensing element of FIG. 21, sectioned according to the line XXV-XXV.

It should be noticed that, for clarity as regards the drawings, the powdered food substance 8 is shown only in FIGS. 1 and 19, where the body of the capsule 1 is illustrated with a window-style interruption to show the inside of the capsule, whilst the powdered food substance 8 is not shown in the other appended figures. The powdered food substance 8 is contained in the zone between a lower filtering element (labelled 3) and an upper filtering element (labelled 4), or between the lower filtering element 3 and a closing element 29 if the upper filtering element is not present.

The capsule 1 comprises first a containment body 2 which is cup-shaped and in which it is possible to identify a tubular lateral wall 21 and a bottom portion 22. The containment body 2 defines a containment chamber 20 inside itself. The tubular lateral wall 21 extends between a first edge 23 and a second edge 24. The bottom portion 22 is connected to the first edge 23 and extends transversally (in particular, perpendicularly) to a central axis 25 of the tubular lateral wall 21, said central axis 25 also being a central axis for the capsule 1. The bottom portion 22 also has a dispensing hole 26, in particular at its central zone. A closing element 29, such as a sheet of multi-layer material able to act as a barrier to oxygen, is fixed to the second edge 24 of the tubular lateral wall 21 to close the top of the containment body 2, as well as the containment chamber 20. The closing element 29 is normally fixed by sealing or gluing.

In the embodiments illustrated, the tubular lateral wall 21 and the bottom portion 22 of the containment body 2 are made in one piece, preferably using a material able to act as a barrier to oxygen, such as a moulded plastic material or a thermoformed multi-layer film.

In the embodiments illustrated in the figures, the bottom portion 22 of the containment body 2 comprises an inner annular zone 221 that surrounds the dispensing hole 26, a middle annular zone 222 that surrounds the inner annular zone 221 and an outer annular zone 223 that surrounds the middle annular zone 222. The three zones are arranged stepped relative to one another, with the inner annular zone 221 further from the closing element 29 than the middle annular zone 222 and the middle annular zone 222 further form the closing element 29 than the outer annular zone 223. In practice, the bottom portion 22 has a projecting part that extends away from the top of the capsule 1. On the inside of the capsule 1, the inner annular zone 221, the middle annular zone 222 and the outer annular zone 223 each define a resting surface that extends transversally relative to the central axis 25. The various resting surfaces are concentric relative to the central axis 25.

In particular, the containment body 2 is made by thermoforming a plastic material which has been rendered a barrier to oxygen, with the dispensing hole 26 which can be made by die cutting. However, in general, the containment body 2 may be made using any material and any method, for example by injection moulding.

A filtering element 3, which in particular is a lower filtering element, is mounted in the containment chamber 20 and is positioned between the powdered food substance 8 and the bottom portion 22. The lower filtering element 3 is, for example, a rigid or semi-rigid plastic element equipped with a plurality of through holes 31. The figures show an example version of the lower filtering element 3, equipped both with radial stiffening ribs 33 and with a central bulge 35 that projects towards the powdered food substance 8. In the example, the radial ribs 33 are provided both on the face of the lower filtering element 3 facing the bottom portion 22 and on the opposite face which faces the powdered food substance 8.

The lower filtering element 3 rests on the inner face of the outer annular zone 223 and is held in place by a shaped indentation 27 made in the tubular lateral wall 21. The lower filtering element 3 is inserted in the capsule 1 for example in a snap-in way.

In the particular embodiment illustrated, the capsule 1 also comprises an upper filtering element 4 which is positioned between the closing element 29 and the powdered food substance 8. The upper filtering element 4 may also be a rigid or semi-rigid plastic element equipped with a plurality of holes 41 and ribs 43. Other embodiments are possible.

The capsule 1 also comprises a dispensing element 5 which is mounted in the containment chamber 20 and is positioned between the lower filtering element 3 and the bottom portion 22. In particular, the dispensing element 5 rests on the inner faces of the middle annular zone 222 and of the inner annular zone 221. Basically, the dispensing element 5 is a flow diverter which, by preventing the beverage from directly reaching the dispensing hole 26, is intended to create a tortuous path for the beverage that, in use, flows towards the dispensing hole 26. The dispensing element 5 is made, for example, of moulded plastic material and is coupled to the bottom portion 22 of the capsule 1.

A first embodiment of a dispensing element 5 is shown in detail in FIGS. 9 to 13, whilst a second embodiment is shown in FIGS. 21 to 25.

In particular, the dispensing element 5 has a first face 51 facing the lower filtering element 3, that is to say, facing towards the top of the capsule 1, and a second face 52 facing towards the bottom portion 22. The dispensing element 5 also has a perimetric face 53, or an annular face, which joins the first face 51 and the second face 52 to each other.

On the first face 51, the dispensing element 5 has a chamber or recess 551 in a central region (in practice, on the central axis 25 of the capsule 1), one or more chambers or recesses 552 in annular regions and a plurality of channels 553 that put said chambers or recesses 551, 552 in communication with each other and with the perimetric face 53. In practice, the central chamber or recess 551 is a pit that collects the beverage to be dispensed, whilst the annular chambers or recesses 552, of which there are two in the embodiment of FIGS. 9 to 13, are concentric grooves that receive the beverage from the central chamber 551 or from the preceding annular chamber 552. The beverage passes from one chamber to another by travelling along the channels 553, which in particular extend substantially radially. It should be noticed that the central chamber 551 is deeper and more capacious than the annular chambers 552.

On the second face 52, the dispensing element 5 has one or more chambers or recesses 562 in annular regions and a plurality of channels 563 that put said one or more chambers or recesses 562 in communication with the perimetric face 53 and with the dispensing hole 26. In practice, the annular chambers or recesses 562, of which there is only one in the embodiment of FIGS. 9 to 13, are concentric grooves that receive the beverage from the perimetric face 53 or from the preceding annular chamber 562. The beverage passes from one chamber to another by travelling along the channels 563, which in particular extend substantially radially, until it reaches the central zone of the second face 52 where the dispensing hole 26 is located.

In order to make it easier to direct the flow of beverage towards the outlet of the capsule 1, the dispensing element 5 comprises a guiding projection 58 on the second face 52, in particular at the centre of the latter. The guiding projection 58 is housed in a central position of the dispensing hole 26 and, in practice, is a peg or the like that projects downwards from the second face 52 and extends in the dispensing hole 26, in such a way as to divert and guide the beverage coming out.

In particular, the dispensing element 5 has, on the perimetric face 53, channels 573 that put the first face 51 and the second face 52 in communication with each other.

As shown in the figures, the dispensing element 5 is entirely housed in the projecting part of the bottom portion 22 of the containment body 2. The first face 51 of the dispensing element 5 is substantially level with the outer annular zone 223, whilst the second face 52 of the dispensing element 5 rests on the middle annular zone 222 and on the inner annular zone 221.

To reach the dispensing hole 26, the beverage which is in the central chamber or recess 551 must follow a tortuous path which passes through the annular chambers 552, 562 and the channels 553, 563, 573.

It should be noticed that there are many channels 553, 563, 573, they are distributed along the whole perimeter of the dividing walls which divide the chambers 551, 552, 562 from each other, they have small passage cross-section and are not very deep compared with the depth of the chambers 551, 552, 562 that they put in communication with each other. This helps to increase the tortuosity of the path for the beverage.

Thanks to that tortuous path, the dispensing element 5 dampens and slows the flow of beverage. That helps to achieve a regular dispensing without sprays from the dispensing hole 26.

The tortuous path for the beverage involves the first face 51, the perimetric face 53 and the second face 52 of the dispensing element 5.

It should be noticed that the dispensing element 5 by itself could, if necessary, be protected by a patent, for example in a divisional patent application, independently of the other features of the capsule 1.

The capsule 1 also comprises a barrier impermeable to oxygen, mounted in the containment chamber 20 and interposed between the lower filtering element 3 and the dispensing element 5. The barrier impermeable to oxygen is a sheet of flexible material 6, fixed in an oxygen-tight way to the containment body 2 and intended to be torn during use, thereby allowing the beverage to pass through it. Before the capsule 1 is used, the part of the containment chamber 20 that contains the powdered food substance 8 is sealed in an oxygen-tight way. During use of the capsule 1, the closing element 29 and the sheet of flexible material 6 are torn and allow water to enter and beverage to flow out, respectively.

For this purpose, the sheet of flexible material 6 has at least one intended tear zone 60 in which the sheet of flexible material 6 is intended to be torn in use. In the specific embodiment illustrated, the sheet of flexible material 6 has a single intended tear zone 60, which in particular is in a central region of the sheet 6. In practice, the single intended tear zone 60 is located on the central axis 25 of the capsule 1.

In the configuration illustrated, the sheet of flexible material 6 is resting on the dispensing element 5 and is in contact with the first face 51 of the latter. The central chamber 551 of the dispensing element 5 faces towards the sheet of flexible material 6 and surrounds the intended tear zone 60, so that the dispensing element 5 is intended to receive the flow of beverage directly in the central chamber or recess 551.

In the embodiment illustrated, the sheet of flexible material 6 comprises at least one first layer 61 constituted of a film made of plastic material, preferably polyethylene or polyester, and a second layer 62 constituted of an aluminium film, which are coupled to each other. The first layer 61 is interposed between the lower filtering element 3 and the second layer 62, which in turn is interposed between the first layer 61 and the dispensing element 5.

In the intended tear zone 60, the first layer 61 has a cut 615 or a through opening and the first layer 61 is locally detached from the second layer 62 in order to allow the second layer 62 to swell locally towards the bottom portion 22 at the intended tear zone 60, until it bursts, after an increase in pressure on the side of the first layer 61 facing the lower filtering element 3.

In other words, during use of the capsule 1 the pressurised beverage passes through the cut 615 in the first layer of plastic material and acts directly on the second layer 62 of aluminium film in the region detached from the first layer 61, making the second layer 62 swell until the latter yields and tears, thereby opening the passage for the beverage towards the dispensing hole 26.

In particular, the intended tear zone 60 is above the central chamber 551 of the dispensing element 5 and therefore the central chamber 551 itself provides an expansion space for swelling of the second layer 2. It should be noticed that the breaking of the sheet of flexible material 6 is due to the breaking strength of the second layer 62 being exceeded because of the pressure difference between its two faces. It is not due to tearing interpenetration of the sheet 6 and the dispensing element 5. In fact, the tear in the sheet of flexible material 6 affects a region with dimensions much smaller than the central chamber 551 and which therefore is totally enclosed in the self-same central chamber 551.

In the embodiment illustrated, the cut 615 is in the shape of a cross and the detached region is in the shape of a circle. Obviously, other shapes are possible.

The sheet of flexible material 6 may also comprise a layer of adhesive 63 interposed between the first layer 61 and the second layer 62 so as to guarantee that they stick to one another. The layer of adhesive 63 is interrupted at the intended tear zone 60. The sheet of flexible material 6 may also comprise a layer of lacquer 64, applied to the second layer 62 on a face of it opposite to that facing the first layer 61, and if necessary a layer 65 of intertwined plastic fibres, associated with the second layer 62 on the same side as the above-mentioned layer of lacquer 64, in such a way that the second layer 62 remains interposed between the first layer 61 and the layer 65 of intertwined plastic fibres. In particular, the layer 65 of intertwined plastic fibres is constituted of woven or non-woven polyester.

In the preferred embodiment, the thicknesses of the various layers are as follows:

first layer 61 (polyethylene film): 10 μm±4 μm;
layer of adhesive 63: 4 μm±2 μm;
second layer 62 (aluminium film): 7 μm±3 μm;
layer of lacquer 64: 4 μm±2 μm;
layer 65 of woven or non-woven polyester: 11 μm±3 μm.

For example, the thickness of the aluminium layer (second layer 62) is selected in such a way that the second layer 62 tears autonomously when the pressure difference between the two faces of the sheet of flexible material 6 is equal to at least 2 bar, at least at the intended tear zone 60. Depending on the specific technical requirements, obviously the layer of aluminium 62 may be selected with a thickness such that it tears due to pressures of less than 2 bar.

The thicknesses indicated above for the various layers are provided by way of example and may be modified according to the specific technical requirements. In particular, the thicknesses may be in wider ranges than those indicated above. For example, the thickness of the second layer 62 of aluminium could be between 6 μm and 30 μm.

The cut 615 may be made with a laser beam and in particular may be made when the first layer 61 and the second layer 62 are already coupled. In fact, using a laser beam of suitable strength, it is possible to cut the polyethylene but not the aluminium, which simply reflects it. For example, the length of the cut 615 is approximately several millimetres, preferably between 1 and 10 mm, whilst the width of the cut 615 is approximately 0.5 to 1 mm, if necessary approximately 0.5 to 2 mm.

In an alternative embodiment of the sheet of flexible material 6, the first layer 61 and the second layer 62 are glued to one another even in the intended tear zone 60, that is to say, they are not locally detached in that zone. The cut 615, also present in this alternative embodiment, constitutes a local weakening of the sheet of flexible material 6 and allows the pressurised beverage to act directly on the second layer 62 of aluminium film, breaking it at the cut 615.

The capsule 1 also comprises a flow throttling element 7, mounted in the containment chamber 20 in a position interposed between the lower filtering element 3 and the dispensing element 5. The flow throttling element 7 extends transversally to the central axis 25 of the tubular lateral wall 21 and obstructs the passage cross-section for the beverage in the containment chamber 20. In practice, the flow throttling element 7 is a disk that is positioned perpendicularly to the central axis 25 and extends across the entire cross-section of the containment chamber 20.

The flow throttling element 7 has at least one through opening 71 through which, in use, the beverage flows towards the dispensing element 5. In other words, the flow throttling element 7 forces the beverage flow to pass through the at least one through opening 71, which has a passage cross-section that is much smaller than the passage cross-section of the tubular lateral wall 21. Specifically, the flow throttling element 7 is a membrane or a thin plate, for example with a thickness of between 0.03 mm and 3 mm. In particular, said membrane or thin plate is made of plastic material and may be a single layer material (such as polyethylene, polythene or another material that can be sealed onto the material of the containment body 2), a multi-layer material (for example, having a sealable layer, a middle layer made of any plastic material or aluminium, a polyester outer layer) or a polyester+polyester+polypropylene multi-layer material.

Therefore, specifically, the flow throttling element 7 is a flexible sheet made of plastic material.

The at least one through opening 71 is a hole or a cut made in the membrane or thin plate, in particular using a piercing needle which makes a hole in the membrane without removing material. Other methods for making the hole, such as die cutting, are obviously possible.

In the embodiment illustrated, the through opening 71 is a hole with a diameter of between 0.5 mm and 3 mm, in particular a diameter of 1.2 mm. If necessary, in particular embodiments, the diameter of the hole 71 may be greater than 3 mm.

Preferably, the through opening 71 is a hole that is permanently open. That is to say, the material of the flow throttling element 7 does not have any elastic return able to close the hole 71 when the flow throttling element 7 is free of mechanical stresses. Moreover, preferably the hole 71 has the same dimensions before dispensing (that is to say, with the capsule unused) and after dispensing (that is to say, after the capsule has been used). In other words, the material of the flow throttling element 7 does not undergo plastic deformation during use of the capsule 1.

Specifically, the flow throttling element 7 has a single through opening 71, which in particular is in a central region of the flow throttling element 7. In practice, the single through opening 71 is located on the central axis 25 of the capsule 1.

In alternative embodiments, there may be two or more through openings 71, but their number is limited. For example, there could be a maximum of ten or twelve. Preferably, the total passage cross-section of the through openings 71 is less than or equal to 0.5% of the corresponding passage cross-section of the containment chamber 20.

In the embodiment illustrated, the membrane that forms the flow throttling element 7 and the sheet of flexible material 6 of the barrier impermeable to oxygen are superposed one over the other. Specifically, the at least one through opening 71 of the flow throttling element 7 is at the at least one intended tear zone 60 of the sheet of flexible material 6. In other possible embodiments, the positions of the through opening 71 and the intended tear zone 60 do not correspond with one another.

Figure 18:
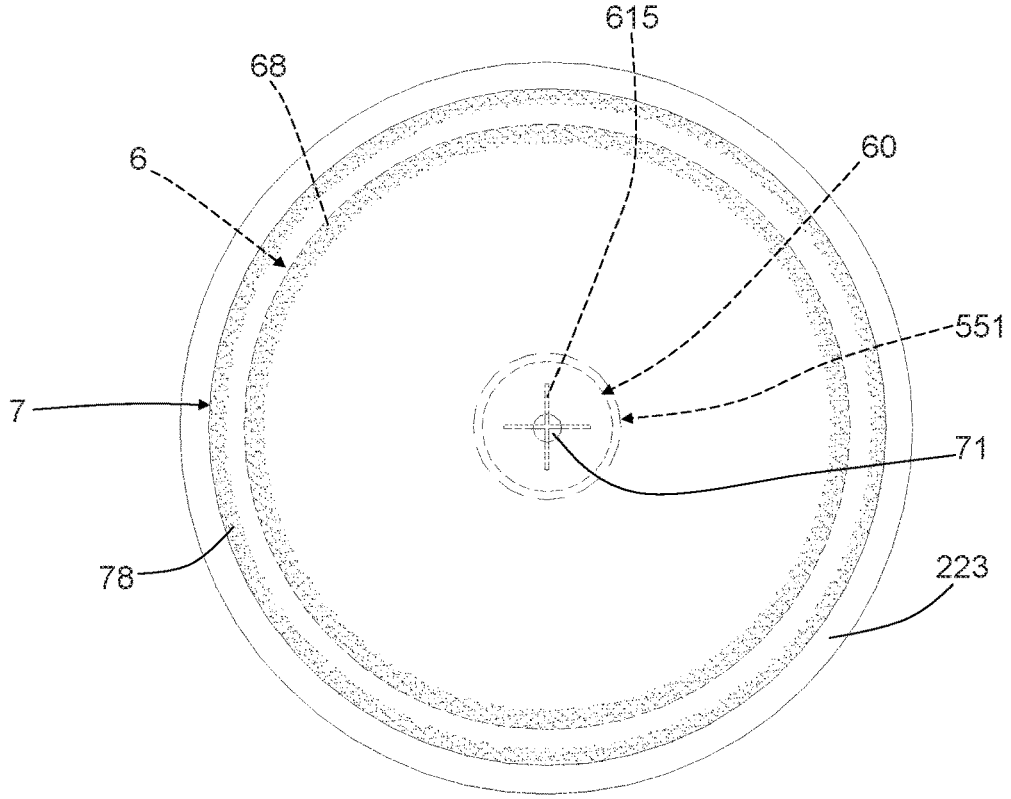
FIG. 18 is a simplified top view of the bottom of the capsule of FIG. 1, showing the flow throttling element of FIG. 14 and the barrier impermeable to oxygen of FIG. 15, which are superposed one over the other.

The sheet of flexible material 6 and the flow throttling element 7 each have a respective perimetric region 68, 78 that is fixed to the containment body 2. As shown in FIG. 18, the sheet of flexible material 6 and the flow throttling element 7 have a circular shape in plan view, but have different diameters. The respective perimetric regions 68, 78 are fixed to the bottom portion 22 (in particular to the outer annular zone 223) for example by sealing or gluing.

In other words, the two sheets 6, 7 are not fixed to one another, instead they are both fixed to the bottom of the capsule 1. Moreover, since the lower filtering element 3 rests on the inner face of the outer annular zone 223, the sheet of flexible material 6 and the flow throttling element 7 are enclosed between the lower filtering element 3, on one side, and the bottom portion 22 and the dispensing element 5, on the other side.

In the specific embodiment, the flow throttling element 7 is interposed between the lower filtering element 3 and the barrier impermeable to oxygen 6, which in turn is interposed between the flow throttling element 7 and the bottom portion 22. In other words, the flow throttling element 7 faces towards the powdered food substance 8 and the barrier impermeable to oxygen 6 faces towards the dispensing outlet 26.

This configuration is useful because it prevents the flow throttling element 7 from being able to interfere with swelling of the intended tear zone 60 before the barrier impermeable to oxygen 6 breaks.

A reverse configuration, in which the barrier impermeable to oxygen 6 is interposed between the lower filtering element 3 and the flow throttling element 7, would still be possible, although it would be less advantageous.

In the embodiment described, in which there is only one through opening 71 and a single intended tear zone 60 present, their positions correspond with one another and they are on the central axis 25, as well as at the central chamber 551 of the dispensing element 5.

It should be noticed that, in the embodiment illustrated, the lower filtering element 3, the flow throttling element 7, the barrier impermeable to oxygen 6 and the dispensing element 5 are elements which are separate from each other, that is to say, they are pieces which are separate from each other and which, if necessary, can be made of materials and with shapes that are different to each other and better suited to their specific purpose.

However, in an alternative embodiment, the flow throttling element 7 and the barrier impermeable to oxygen 6 could be incorporated in one piece. In other words, a multi-layer element could be supplied, having a first layer that is a membrane or thin plate (for example, a flexible sheet made of the materials indicated above for the flow throttling element 7) with at least one through opening 71, said first layer being coupled to a sheet of flexible material 6 as described above for the barrier impermeable to oxygen. The multi-layer element obtained in this way, formed by the membrane or thin plate with the through opening 71 and by the sheet of flexible material 6, coupled to each other, is fixed to the containment body 2 of the capsule 1, in particular on the inner side of the outer annular zone 223 of the bottom portion 22. In that multi-layer element, the through opening 71 is preferably at the intended tear zone 60.

FIGS. 19 to 25 relate to a second embodiment of a capsule 1, which differs from the first embodiment described above mainly in terms of the dispensing element 5 and consequently in terms of its seat in the bottom portion 22.

In particular, in the capsule of FIG. 19 the dispensing element 5 and its seat have a diameter greater than the respective ones of the capsule shown in FIG. 1.

As shown in FIGS. 21 to 25, the dispensing element 5 has four chambers or recesses 552 in concentric annular regions of the first face 51 and three chambers or recesses 562 in concentric annular regions of the second face 52. Compared with the dispensing element 5 of the first embodiment, that allows an increase in the tortuosity of the flow path of the beverage coming out.

Operation of a capsule 1 according to this invention is briefly described below.

When the capsule 1 is inserted in the beverage-making machine (for example, a coffee maker), a suitable piercing element belonging to the latter pierces the closing element 29 and injects pressurised hot water into the containment chamber 20 through the closing element 29 itself. After passing through the upper filtering element 4, if one is present, which also serves to distribute the water fed in, the water reaches the powdered food substance 8 and wets it, thereby starting the beverage making process, that is to say, the dissolving of the powdered food substance 8 if it is soluble, or extraction of the aromatic substances if the powdered food substance 8 is not soluble.

The beverage that is made reaches the lower filtering element 3 and, passing through the latter, whose function is to retain the powdered food substance 8 to prevent that substance from getting out, reaches the flow throttling element 7. Passing through the at least one through opening 71, the beverage reaches the sheet of flexible material 6 which is still intact and the beverage is stopped by the latter. Following the increase of pressure inside the capsule 1, the beverage goes through the at least one cut 615 of the first layer 61 of the sheet of flexible material 6 and reaches the second layer 62 at the at least one intended tear zone 60.

The pressure difference gradually created between the face of the sheet of flexible material 6 facing the powdered food substance 8 and the opposite face causes local swelling of the second layer 62 towards the bottom portion 22, in particular in the central chamber 551 of the dispensing element 5, until the second layer 62 tears in the intended tear zone 60.

Depending on the pressure difference and the specific mechanical properties of the sheet of flexible material, the actual tear caused in the second layer 62 may have dimensions that are much smaller than the dimensions of the region in which the first layer 61 and the second layer 62 are detached from each other in the intended tear zone 60. For example, the tear may have dimensions comparable to or even smaller than those of the cut 615.

It should be noticed that the different mechanical properties of the materials that constitute the first layer 61 and the second layer 62 mean that, whilst the second layer 62 tears following the pressure increase, the first layer 61 may remain substantially undamaged.

At that point the beverage is free to continue on its path and falls into the central chamber 551 of the dispensing element 5, from which it reaches the dispensing hole 26 by following a tortuous path on the first face 51, on the perimetric face 53 and on the second face 52.

After the sheet of flexible material 6 has torn and as the beverage is coming out of the capsule 1, the flow throttling element 7, thanks to the passage cross-section that is limited to the at least one opening 71, creates resistance to the flow of beverage between the zone where the powdered food substance 8 is located and the dispensing element 5. In practice, the flow throttling element 7 imposes a pressure drop through it.

Therefore, the flow throttling element 7 has a flow regulator function, enabling the flow of beverage in the capsule 1 to be slowed and rendered regular.

The flow throttling element 7 may be useful for maintaining some counter-pressure upstream of it (that is to say, in the infusion region where the powdered food substance 8 is located) even after the sheet of flexible material 6 has broken. This aspect can enable improved beverage extraction.

In the case of capsules 1 for coffee, some tests have demonstrated specifically that, at the end of dispensing, the "tablet" of coffee powder remaining in the containment chamber 20 is more compact and solid than the "tablet" of prior art capsules which use the same coffee powder. That may be considered an indicator of improved extraction achievable with the capsules 1 according to this invention.

Moreover, at the end of dispensing, the flow throttling element 7 helps to prevent or at least to slow the dripping of residual water which tends to descend from the powdered food substance towards the bottom of the capsule 1. In fact, even more so in the absence of a significant pressure difference, it is a considerable obstacle in the path of the residual water, which can only pass through the small hole 71.

This invention brings important advantages.

Thanks to this invention it was possible not just to provide an alternative capsule to the prior art capsules which can be used in the same machines that currently use the prior art capsules described above, but improved results were also achieved, as mentioned above.

Moreover, using the specific sheet of flexible material described above as the barrier impermeable to oxygen, it is possible to provide a system for opening of the capsule that is not only an alternative to the prior art system, but that enables both opening using pressures greater than those at which prior art capsules open, and reduction of the risk of unwanted releasing of pieces of aluminium into the beverage, thanks to the absence of mechanical piercing elements which interact with the aluminium sheet.

Finally, it should be noticed that this invention is relatively easy to produce and that even the cost linked to implementing the invention is not very high. The invention described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. A capsule (1) for making a beverage, containing a powdered food substance (8) which enables a beverage to be made by passing water through the powdered food substance (8), the capsule (1) comprising:

a cup-shaped containment body (2) in turn comprising a tubular lateral wall (21), extending between a first edge (23) and a second edge (24), and a bottom portion (22) connected to the first edge (23) and extending transversally to a central axis (25) of the tubular lateral wall (21), the bottom portion (22) comprising a dispensing hole (26), and the cup-shaped containment body (2) defining a containment chamber (20) that is inside the cup-shaped containment body (2);

a closing element (29) fixed to the second edge (24) to close a top of the cup-shaped containment body (2);

a filtering element (3) mounted in the containment chamber (20) and positioned between the powdered food substance (8) and the bottom portion (22);

a dispensing element (5), mounted in the containment chamber (20) and positioned between the filtering element (3) and the bottom portion (22), the dispensing element (5) being intended to create a tortuous path for the beverage that, in use, flows towards the dispensing hole (26);

a barrier impermeable to oxygen (6), mounted in the containment chamber (20) and interposed between the filtering element (3) and the dispensing element (5), the barrier impermeable to oxygen (6) being a sheet of flexible material that is fixed to the cup-shaped containment body (2) and is intended to be torn during use, thereby allowing the beverage to pass through the barrier impermeable to oxygen (6);

a flow throttling element (7) that is mounted in the containment chamber (20) and extends transversally to a central axis (25) of the tubular lateral wall (21), the flow throttling element (7) obstructing a passage cross-section for the beverage in the containment chamber (20), wherein the flow throttling element (7) is mounted in a position interposed between the filtering element (3) and the dispensing element (5) and has at least one through opening (71) through which, in use, the beverage flows towards the dispensing element (5) wherein the flow throttling element (7) is interposed between the filtering element (3) and the barrier impermeable to oxygen (6).

2. The capsule (1) according to claim 1, wherein the flow throttling element (7) is a membrane or a plate and wherein said at least one through opening (71) is a hole or a cut made in the membrane or plate.

3. The capsule (1) according to claim 1, wherein said at least one through opening (71) of the flow throttling element (7) is a permanently open hole.

4. The capsule (1) according to claim 3, wherein said at least one through opening (71) of the flow throttling element (7) has a diameter of between 0.5 mm and 3 mm.

5. The capsule (1) according to claim 1, wherein the flow throttling element (7) has a single through opening (71).

6. The capsule (1) according to claim 1, the flow throttling element (7) being a membrane or a plate, wherein said membrane or plate and the sheet of flexible material of the barrier impermeable to oxygen (6) are superposed one over the other and each of them has a perimetric region (78, 68) that is fixed to the cup-shaped containment body (2).

7. The capsule (1) according to claim 1, the flow throttling element (7) being a membrane or a plate, wherein said membrane or plate and the sheet of flexible material of the barrier impermeable to oxygen (6) are coupled to each other to form a multi-layer element that is fixed to the cup-shaped containment body (2).

8. The capsule (1) according to claim 1, wherein the sheet of flexible material of the barrier impermeable to oxygen (6) has at least one intended tear zone (60) in which the sheet of flexible material is intended to be torn in use.

9. The capsule (1) according to claim 8, wherein the at least one through opening (71) of the flow throttling element (7) is at the at least one intended tear zone (60) of the sheet of flexible material of the barrier impermeable to oxygen (6).

10. The capsule (1) according to claim 8, wherein the sheet of flexible material of the barrier impermeable to oxygen (6) comprises at least a first layer (61) constituted of a film made of plastic material and a second layer (62) constituted of an aluminium film, coupled to each other, the first layer (61) being interposed between the filtering element (3) and the second layer (62), wherein, in the at least one intended tear zone (60), the first layer (61) has a cut or through opening (615) and the second layer (62) is able to swell towards the bottom portion (22) at the at least one intended tear zone (60), until the second layer (62) bursts, after an increase in pressure on the side of the first layer (61) facing the filtering element (3).

11. The capsule (1) according to claim 8, wherein the sheet of flexible material of the barrier impermeable to oxygen (6) rests on the dispensing element (5) and wherein the dispensing element (5) has a chamber or recess (551) on the side facing the barrier impermeable to oxygen (6), said chamber or recess (551) surrounding the at least one intended tear zone (60), so that the dispensing element (5) is intended to receive the flow of beverage in said chamber or recess (551).

12. The capsule (1) according to claim 8, wherein the sheet of flexible material of the barrier impermeable to oxygen (6) has a single intended tear zone (60).

13. The capsule (1) according to claim 1, wherein the dispensing element (5) has a first face (51) facing the filtering element (3), a second face (52) facing the bottom portion (22) of the cup-shaped containment body (2) and a perimetric face (53) which joins the first face (51) and the second face (52) to each other, the dispensing element (5) having, on the first face (51), a chamber or recess (551) in a central region, one or more chambers or recesses (552) in annular regions, a plurality of channels (553) that put said chamber or recess (551) in the central region and said one or more chambers or recesses (552) in the annular regions in communication with each other and with the perimetric face (53), the dispensing element (5) having, on the second face (52), one or more chambers or recesses (562) in annular regions and a plurality of channels (563) that put said one or more chambers or recesses (562) in communication with the perimetric face (53) and with the dispensing hole (26), the tortuous path for the beverage involving the first face (51), the perimetric face (53) and the second face (52) of the dispensing element (5).

14. The capsule (1) according to claim 13, wherein the dispensing element (5) has, on the perimetric face (53), channels (573) that put the first face (51) and the second face (52) in communication with each other.

15. The capsule (1) according to claim 13, wherein the dispensing element (5) comprises, on the second face (52), a guiding projection (58) that is housed in a central position of the dispensing hole (26).

16. The capsule (1) according to claim 1, wherein the flow throttling element (7) is a membrane or a plate and wherein said at least one through opening (71) is a hole or a cut made in the membrane or plate.

17. The capsule (1) according to claim 1, wherein the flow throttling element (7) is a membrane or a plate and wherein said at least one through opening (71) is a single through opening (71) made in a central region of the membrane or plate.

18. The capsule (1) according to claim 17, wherein said single through opening (71) is a permanently open hole having a diameter of between 0.5 mm and 3 mm.

19. The capsule (1) according to claim 17, wherein the flow throttling element (7) is interposed between the filtering element (3) and the barrier impermeable to oxygen (6).

20. The capsule (1) according to claim 19, wherein the sheet of flexible material of the barrier impermeable to oxygen (6) has a single intended tear zone (60) in which the sheet of flexible material is intended to be torn in use; and wherein the single through opening (71) is at the single intended tear zone (60) of the sheet of flexible material of the barrier impermeable to oxygen (6).

21. The capsule (1) according to claim 1, wherein the filtering element (3) is equipped with a plurality of through holes (31) and wherein the filtering element (3) and the flow throttling element (7) are pieces which are separate from each other.

* * * * *